US011480363B2

(12) United States Patent
Phillips

(10) Patent No.: US 11,480,363 B2
(45) Date of Patent: Oct. 25, 2022

(54) FILTER ASSEMBLY FOR AN AIR CONDITIONING APPLIANCE

(71) Applicant: Haier US Appliance Solutions, Inc., Wilmington, DE (US)

(72) Inventor: Richard Michael Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 139 days.

(21) Appl. No.: 16/916,609

(22) Filed: Jun. 30, 2020

(65) Prior Publication Data

US 2021/0404704 A1 Dec. 30, 2021

(51) Int. Cl.

| | |
|---|---|
| ***F25D 19/00*** | (2006.01) |
| ***F24F 13/28*** | (2006.01) |
| ***F24F 1/0007*** | (2019.01) |
| ***F24F 13/20*** | (2006.01) |

(52) U.S. Cl.
CPC ..... *F24F 13/28* (2013.01); *F24F 1/0007* (2013.01); *F24F 13/20* (2013.01)

(58) Field of Classification Search
CPC ..... F24F 13/28; F24F 13/20; F24F 13/085; F24F 1/0007; F24F 1/035
USPC ..... 62/298
See application file for complete search history.

(56) References Cited

U.S. PATENT DOCUMENTS

| | | | | |
|---|---|---|---|---|
| 6,082,127 | A * | 7/2000 | Correa | F24F 13/20 62/297 |
| 2006/0010896 | A1* | 1/2006 | Choi | F24F 13/20 62/262 |
| 2007/0266685 | A1* | 11/2007 | Ferguson | F24F 13/085 55/490 |
| 2019/0321769 | A1* | 10/2019 | Kim | B03C 3/019 |

FOREIGN PATENT DOCUMENTS

| | | |
|---|---|---|
| CN | 101726086 A | 6/2010 |
| CN | 203298462 U | 11/2013 |
| KR | 100753448 B1 | 8/2007 |

* cited by examiner

*Primary Examiner* — Henry T Crenshaw
*Assistant Examiner* — Kamran Tavakoldavani
(74) *Attorney, Agent, or Firm* — Dority & Manning, P.A.

(57) ABSTRACT

A filter assembly for an air conditioner unit includes a filter frame defining a plurality of attachment features for engaging a plurality of mounting features defined on an inlet frame of a cabinet of the air conditioner unit to secure the filter frame over the indoor inlet. A filter screen is attached to the filter frame for filtering a flow of air through the indoor inlet and the filter frame defines a mounting bracket for a secondary air filter.

20 Claims, 10 Drawing Sheets

FILTER ASSEMBLY FOR AN AIR CONDITIONING APPLIANCE

FIELD OF THE INVENTION

The present subject matter relates generally to air conditioning appliances, and more particularly to filter assemblies for air conditioning appliances.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU), or package terminal air conditioners (PTAC) may be utilized to adjust the temperature in, for example, a single room or group of rooms of a structure. These units typically operate like split heat pump systems, except that the indoor and outdoor portions are defined by a bulkhead and all system components are housed within a single package. In this regard, such units commonly include an indoor portion that communicates (e.g., exchanges air) with the area within a building and an outdoor portion that generally communicates (e.g., exchanges air) with the area outside a building. Accordingly, the air conditioner unit generally extends through, for example, an outer wall of the structure, or is otherwise ducted to the outdoors.

Notably, hotel owners (or users of air conditioner units in general) frequently require differing levels of air filtration depending on environmental factors and conditioned space needs. In order to increase the level of filtration while maintaining a certain system airflow, more filter media can be used (for example, in a pleated configuration), leading to a deeper/thicker filter size. Typical air conditioner systems only accommodate one depth/thickness of filter. Alternatively, certain air conditioner systems may permit the use of interchangeable filters, but often require complex and costly installation procedures for each filter.

Accordingly, improved air conditioner units having improved filter assemblies would be useful. More specifically, a filter assembly that is simple to install and accommodates different filter sizes would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioner unit defining a vertical, a lateral, and a transverse direction is provided. The air conditioner unit includes a cabinet defining an indoor inlet and a plurality of mounting features, a bulkhead positioned within the cabinet and defining an indoor portion and an outdoor portion, and a filter assembly positioned adjacent the indoor inlet. The filter assembly includes a filter frame defining a plurality of attachment features for engaging the plurality of mounting features to secure the filter frame over the indoor inlet and a filter screen attached to the filter frame for filtering a flow of air through the indoor inlet.

In another exemplary aspect of the present disclosure, a filter assembly for an air conditioner unit is provided. The air conditioner unit includes a cabinet defining an indoor inlet and a plurality of mounting features. The filter assembly includes a filter frame defining a plurality of attachment features for engaging the plurality of mounting features to secure the filter frame over the indoor inlet and a filter screen attached to the filter frame for filtering a flow of air through the indoor inlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
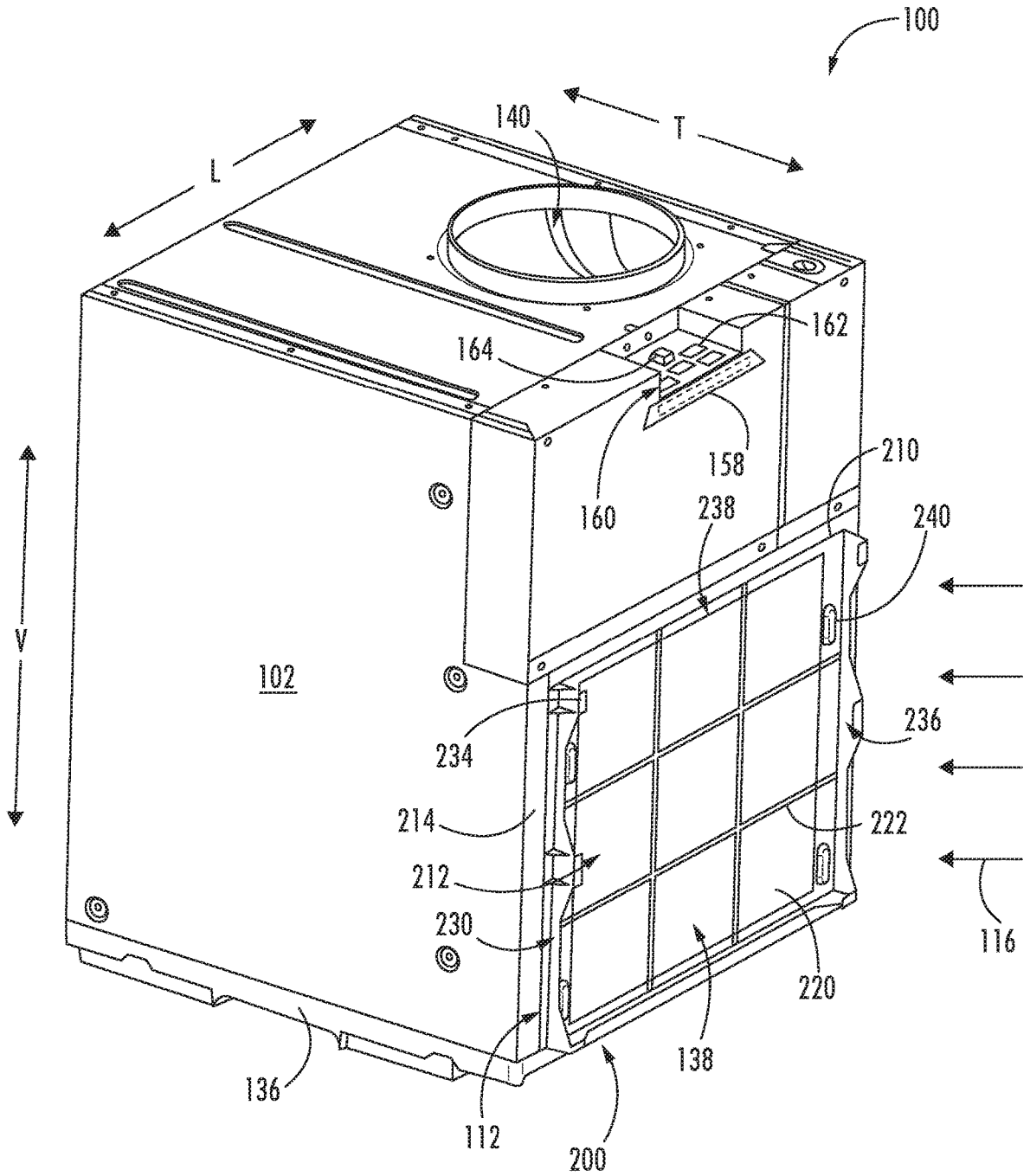
FIG. 1 provides a perspective view of an air conditioning appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
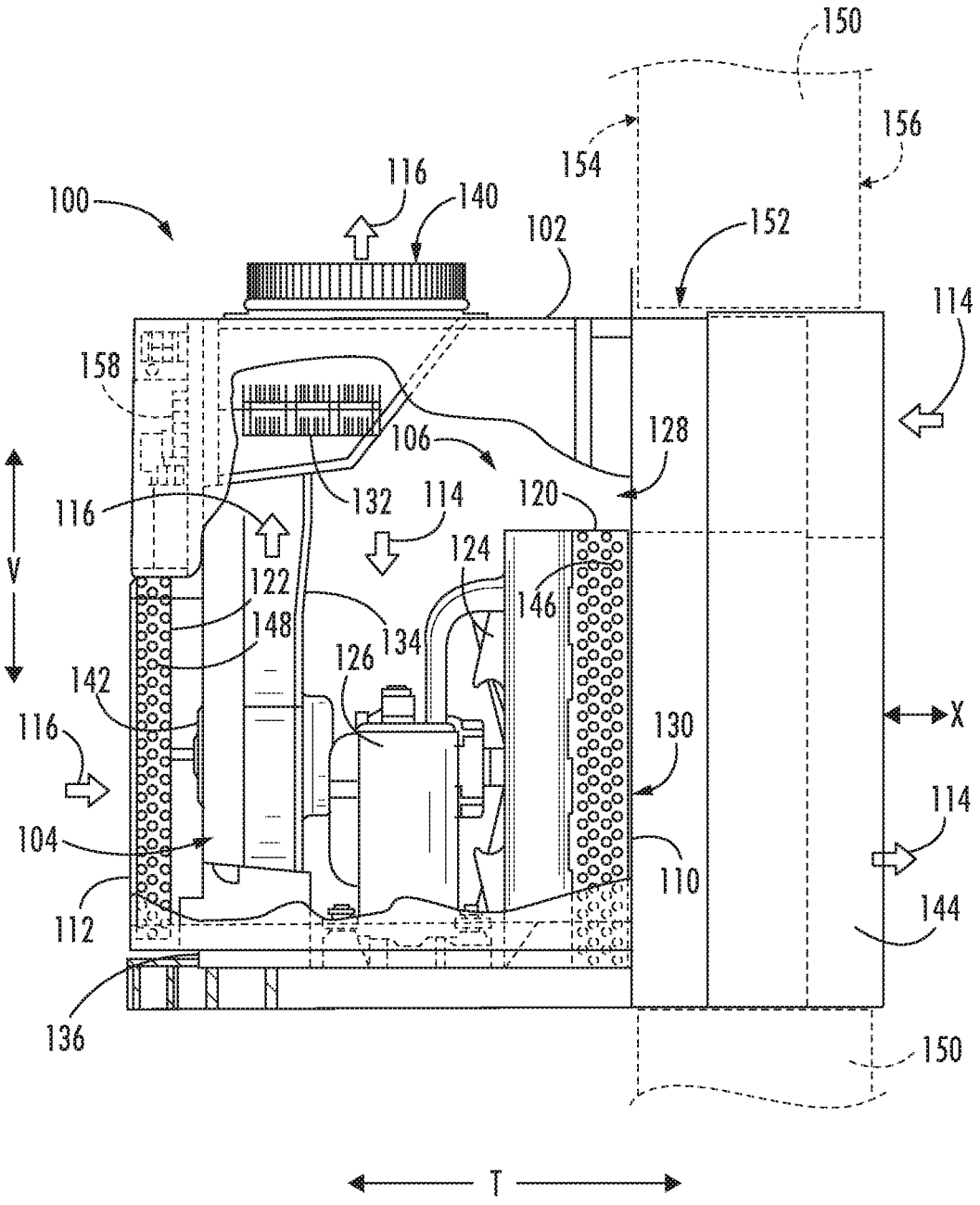
FIG. 2 provides a section view of the exemplary air conditioning appliance of FIG. 1.
Figure 3:
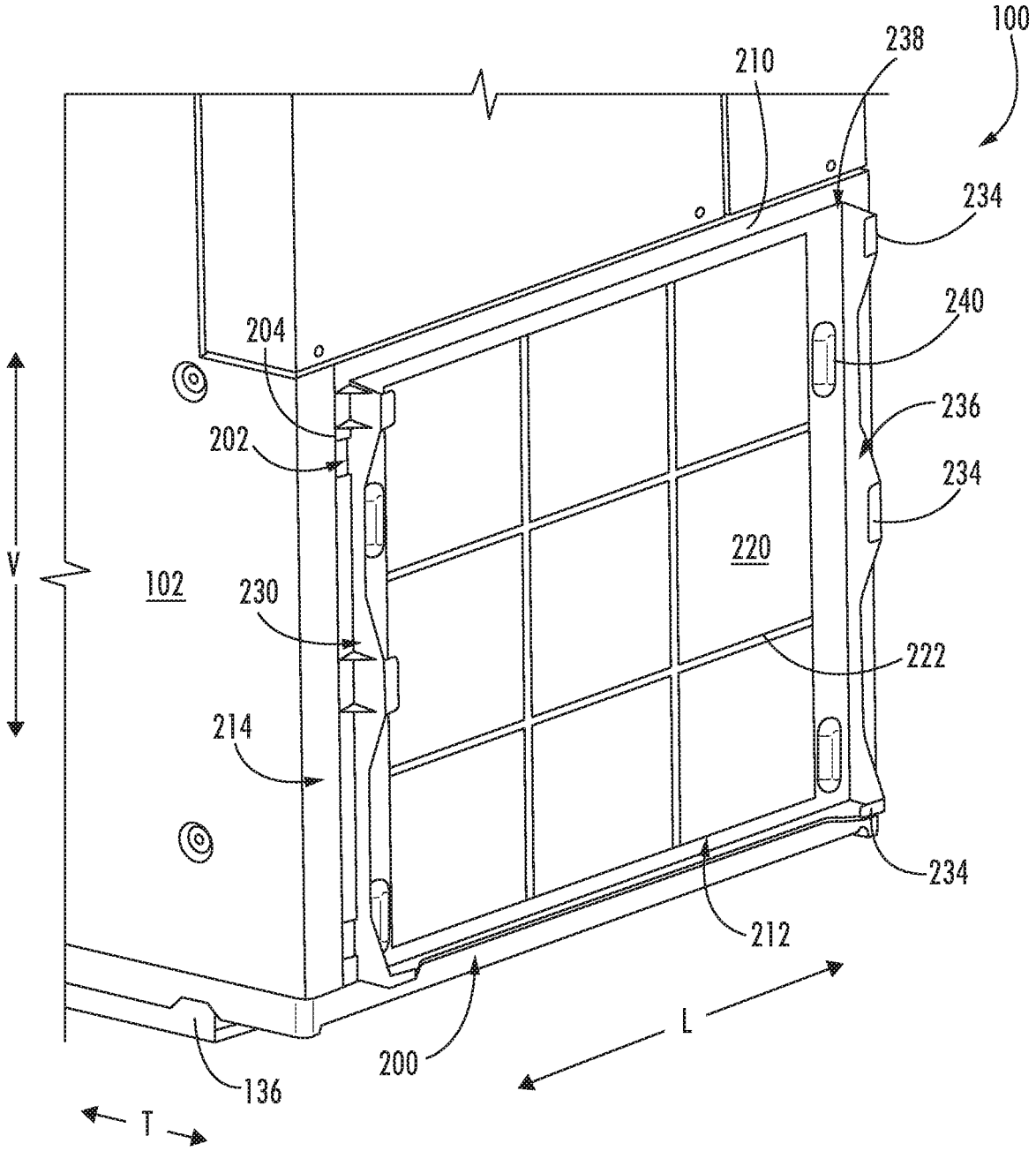
FIG. 3 provides a close-up perspective view of a filter assembly mounted to a cabinet of the exemplary air conditioning appliance of FIG. 1.

Turning now to the figures, FIGS. 1 and 2 illustrate an exemplary air conditioner appliance (e.g., air conditioner 100). Specifically, FIG. 1 provides a perspective view and FIG. 2 provides a cross sectional view of air conditioner 100. As shown, air conditioner 100 may be provided as a one-unit type air conditioner 100, such as a single-package vertical unit (SPVU). However, it should be appreciated that aspects of the present subject matter may be used with other suitable air conditioning units or air filtering devices, such as a packaged terminal air conditioner unit (PTAC), a split heat pump system, etc.

Air conditioner 100 includes a package housing or cabinet 102 supporting and defining an indoor portion 104 and an outdoor portion 106. Generally, air conditioner 100 generally defines a vertical direction V, a lateral direction L, and a transverse direction T. Each direction V, L, T is perpendicular to each other, such that an orthogonal coordinate system is generally defined.

In some embodiments, cabinet 102 contains various other components of the air conditioner 100. Cabinet 102 may include, for example, a rear opening 110 (e.g., with or without a grill or grate thereacross) and a front opening 112 (e.g., with or without a grill or grate thereacross) may be spaced apart from each other along the transverse direction T. The rear opening 110 may be part of the outdoor portion 106, while the front opening 112 is part of the indoor portion 104. Components of the outdoor portion 106, such as an outdoor heat exchanger 120, outdoor fan 124, and compressor 126 may be enclosed within cabinet 102 between front opening 112 and rear opening 110. In certain embodiments, one or more components of outdoor portion 106 are mounted on a base 136, as shown. According to exemplary embodiments, base 136 may be received within a drain pan, e.g., for collecting condensation formed during operation.

During certain operations, air 114 may be drawn to outdoor portion 106 through rear opening 110. Specifically, an outdoor inlet 128 defined through cabinet 102 may receive outdoor air 114 motivated by outdoor fan 124. Within cabinet 102, the received outdoor air 114 may be motivated through or across outdoor fan 124. Moreover, at least a portion of the outdoor air 114 may be motivated through or across outdoor heat exchanger 120 before exiting the rear opening 110 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 104 may include an indoor heat exchanger 122, a blower fan 142, and a heating unit 132. These components may, for example, be housed behind the front opening 112. A bulkhead 134 may generally support or house various other components or portions thereof of the indoor portion 104, such as the blower fan 142. Bulkhead 134 may generally separate and define the indoor portion 104 and outdoor portion 106 within cabinet 102. Additionally, or alternatively, bulkhead 134 or indoor heat exchanger 122 may be mounted on base 136 (e.g., at a higher vertical position than outdoor heat exchanger 120), as shown.

During certain operations, air 116 may be drawn to indoor portion 104 through front opening 112. Specifically, an indoor inlet 138 defined through cabinet 102 may receive indoor air 116 motivated by blower fan 142. At least a portion of the indoor air 116 may be motivated through or across indoor heat exchanger 122 (e.g., before passing to bulkhead 134). From blower fan 142, indoor air 116 may be motivated (e.g., across heating unit 132) and returned to the indoor area of the room through an indoor outlet 140 defined through cabinet 102 (e.g., above indoor inlet 138 along the vertical direction V). Optionally, one or more conduits (not pictured) may be mounted on or downstream from indoor outlet 140 to further guide air 116 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

According to exemplary embodiments, air conditioner 100 may further include a plenum 144 to direct air to or from cabinet 102. When installed, plenum 144 may be selectively attached to (e.g., fixed to or mounted against) cabinet 102 (e.g., via a suitable mechanical fastener, adhesive, gasket, etc.) and extend through a structure wall 150 (e.g., an outer wall of the structure within which air conditioner 100 is installed) and above a floor of the structure. In particular, plenum 144 extends along an axial direction X (e.g., parallel to the transverse direction T) through a hole or channel 152 in the structure wall 150 that passes from an internal surface 154 to an external surface 156. In addition, it should be appreciated that plenum 144 may be formed from two or more telescoping structures, e.g., to accommodate different thicknesses of structure wall 150.

The operation of air conditioner 100 including compressor 126 (and thus the sealed system generally), blower fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Referring now generally to FIGS. 1 through 10, a filter assembly 200 that may be used with air conditioner 100 will be described according to exemplary embodiments of the present subject matter. Specifically, filter assembly 200 is generally positioned somewhere along the flow path of indoor air 116 to remove dust, VOCs, allergens, mold spores, bacteria, viruses, pollen, dander, and other contaminants from indoor air 116. According to the illustrated embodiment, filter assembly 200 is positioned adjacent indoor inlet 138 to remove contaminants before indoor air 116 passes over indoor heat exchanger 122. However, it should be appreciated that according to alternative embodiments, filter assembly 200 may be positioned at any other suitable location within indoor portion 104. Indeed, according to still other embodiments, filter assembly 200 may be used to filter outdoor air 114 passing through the outdoor portion 106, or may otherwise be used for filtering a flow of air in any other suitable appliance. The application described herein is only exemplary and not intended to limit the scope of the present subject matter.

Figure 4:
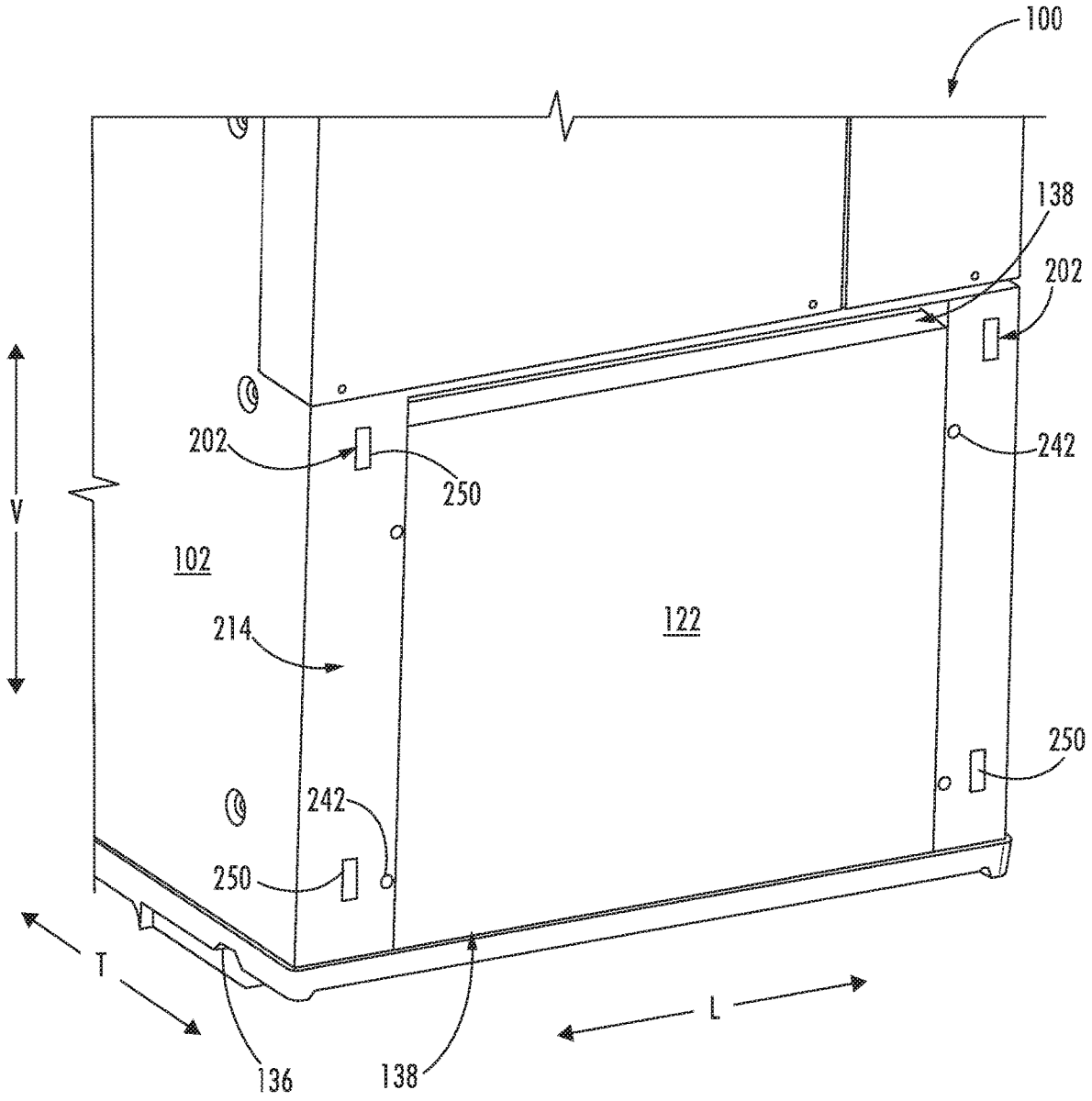
FIG. 4 provides a close-up perspective view of an inlet frame of the cabinet of the exemplary air conditioning appliance of FIG. 1.
Figure 5:
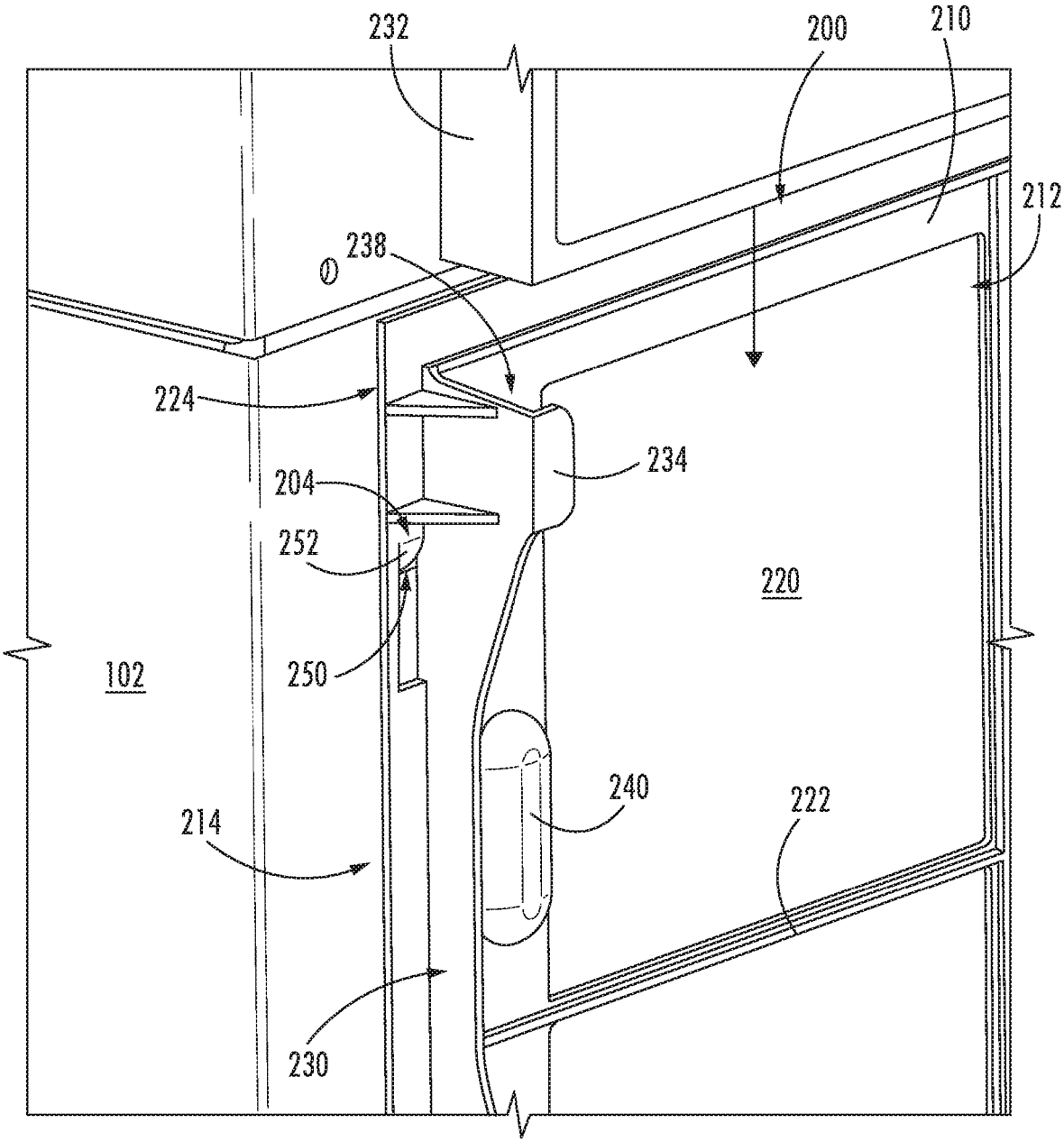
FIG. 5 provides a close-up perspective view of mounting features and attachment features for securing the filter assembly the cabinet of the exemplary air conditioning appliance of FIG. 1.

Referring now specifically to FIGS. 4 and 5, air conditioner 100 and filter assembly 200 may include various features for facilitating the quick and easy installation of filter assembly 200. In this regard, for example, cabinet 102 may define a plurality of mounting features (e.g., identified generally herein by reference numeral 202) and filter assembly 200 may define a plurality of attachment features (e.g., identified generally herein by reference numeral 204). In general, mounting features 202 and attachment features 204 are complementary to each other and are designed to engage each other when filter assembly 200 is installed onto air conditioner 100. In this manner, mounting features 202 and attachment features 204 are designed to secure filter assembly 200 to cabinet 102. In addition, such features may eliminate the need for installing the mechanical fasteners to secure filter assembly 200.

More specifically, filter assembly 200 may include a filter frame 210 that has dimensions substantially similar to indoor inlet 138 and defines a flow opening 212 through which indoor air 116 may flow into the indoor portion 104. In this regard, for example, filter frame 210 may be a substantially square or rectangular frame that is designed to be mounted directly to cabinet 102. Similarly, cabinet 102 may define an inlet frame 214 that generally surrounds and defines the boundary of indoor inlet 138. It should be appreciated that inlet frame 214 and filter frame 210 may be formed from any suitably rigid materials. For example, according to the illustrated embodiment, inlet frame 214 is part of cabinet 102 and is formed from sheet metal or a rigid plastic bracket. By contrast, filter frame 210 may be injected molded from plastic. According to alternative embodiments, filter frame 210 and inlet frame 214 may be formed by injection molding, e.g., using a suitable plastic material, such as injection molding grade high impact polystyrene (HIPS) or acrylonitrile butadiene styrene (ABS). Alternatively, according to another exemplary embodiment, these components may be compression molded, e.g., using sheet molding compound (SMC) thermoset plastic or other thermoplastics. Other suitable materials and manufacturing methods for forming filter assembly 200 and inlet frame 214 are possible and within the scope of the present subject matter.

Figure 7:
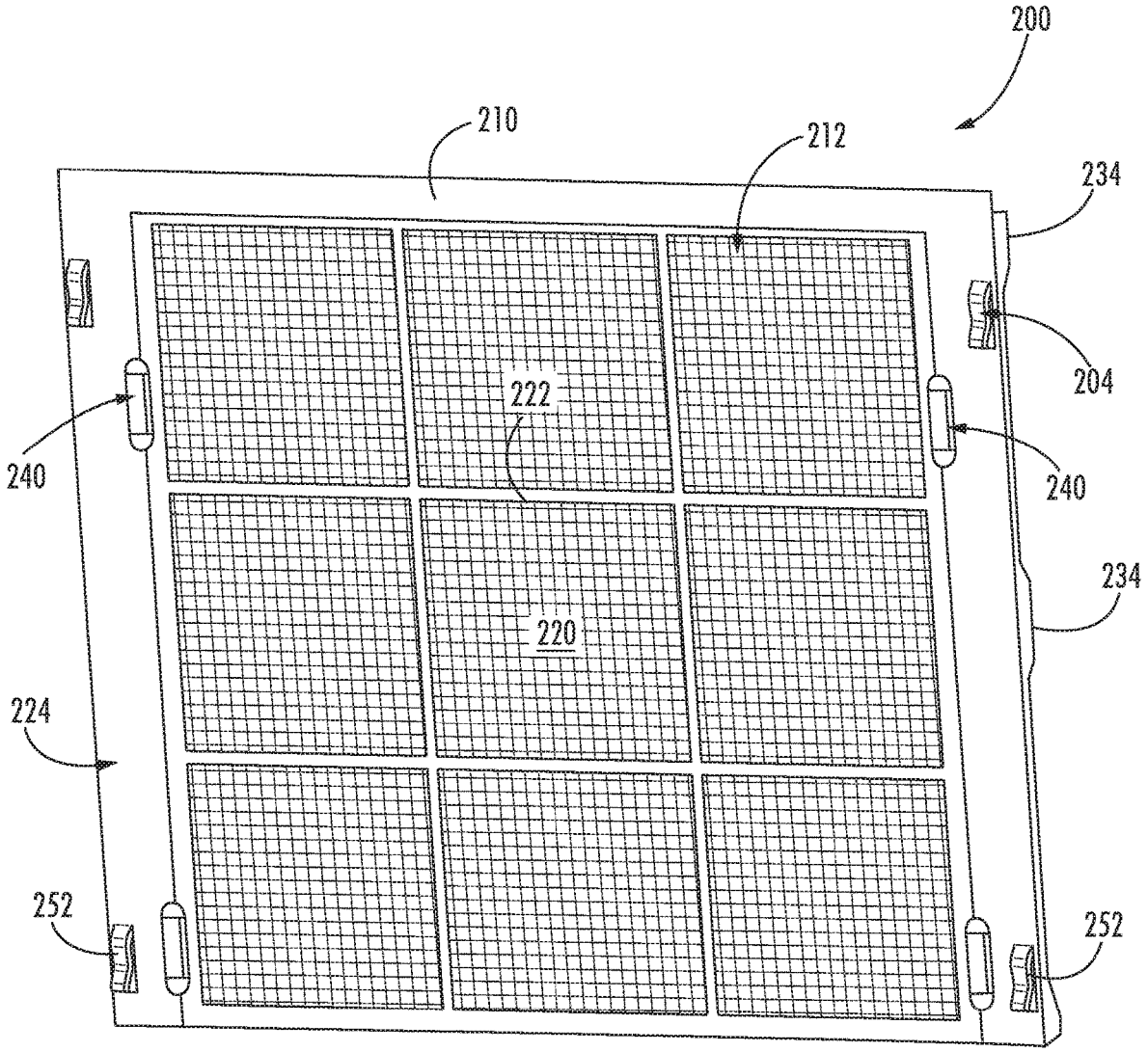
FIG. 7 provides a rear perspective view of the exemplary filter assembly of FIG. 3.
Figure 8:
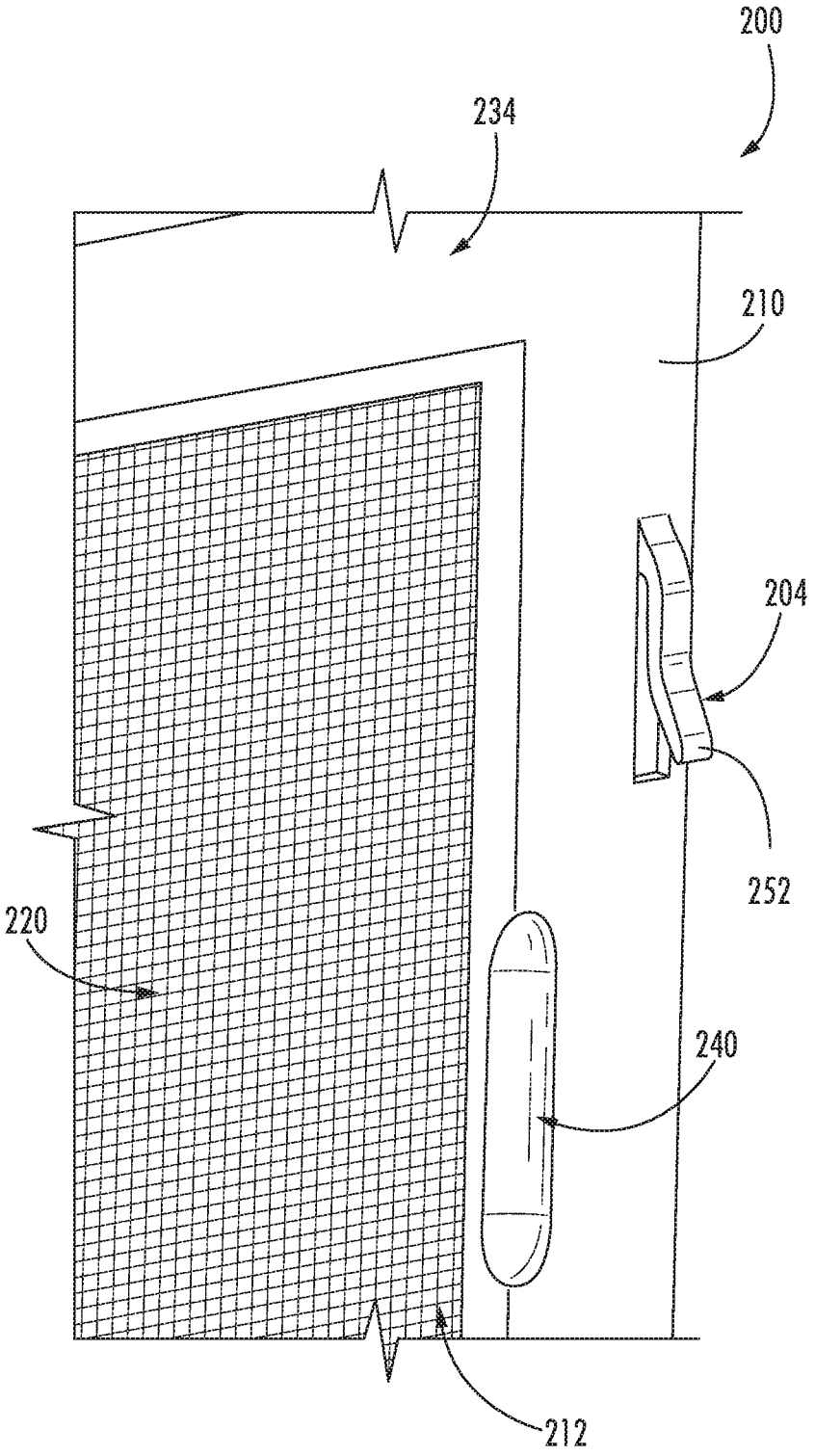
FIG. 8 provides another rear perspective view of the exemplary filter assembly of FIG. 3.

In addition, as best illustrated in FIGS. 7 and 8, filter assembly 200 may include a filter screen 220 that is attached to filter frame 210 for filtering the flow of air through flow opening 212, e.g., such as indoor air 116 through indoor inlet 138. In general, filter screen 220 may be any suitable mesh or cross-linked screen that is designed to filter particulates from indoor air 116. According to exemplary embodiments, filter screen 220 may be a substantially rigid plastic mesh that may be cleaned with a vacuum and/or warm, soapy water. Filter screen 220 is sufficiently rigid and durable for repeated use throughout the lifetime of filter assembly 200 and/or air conditioner 100. In addition, according to exemplary embodiments, filter screen 220 may act as the primary air filter for air conditioner 100. However, as described in more detail below, filter assembly 200 may further include features for facilitating the use of a secondary air filter or filters for improved air filtration.

Notably, filter screen 220 may be formed integrally with filter frame 210, e.g., by compression molding or injection molding. According still other embodiments, an overmolding process may be used to join filter screen 220 to filter frame 210, or vice versa. In this regard, for example, filter screen 220 may be overmolded onto filter frame 210. Overmolding is a process by which a previously molded part proceeds through a second molding process to add an additional feature, material, or component. Overmolding may be used to bond filter frame 210 and filter screen 220 to form a single integral part. It should be appreciated that filter screen 220 and filter frame 210 may be formed from the same or dissimilar materials as desired for a particular application.

In addition, in order to improve the rigidity of filter assembly 200, e.g., to withstand the flow of indoor air 116, filter assembly 200 may further include one or more cross supports 222 that extend within a plane orthogonal to the transverse direction T (e.g., when filter assembly 200 is installed). Such cross supports 222 may be positioned at an aft end 224 of filter frame 210, e.g., at a downstream end relative to the flow of indoor air 116. In general, cross supports 222 may be rigid bars formed in any suitable pattern for supporting filter screen 220. In addition, cross supports 222 may help filter assembly 200 withstand forces generated when a secondary air filter is urged against the filter frame 210 under the force of indoor air 116.

Figure 6:
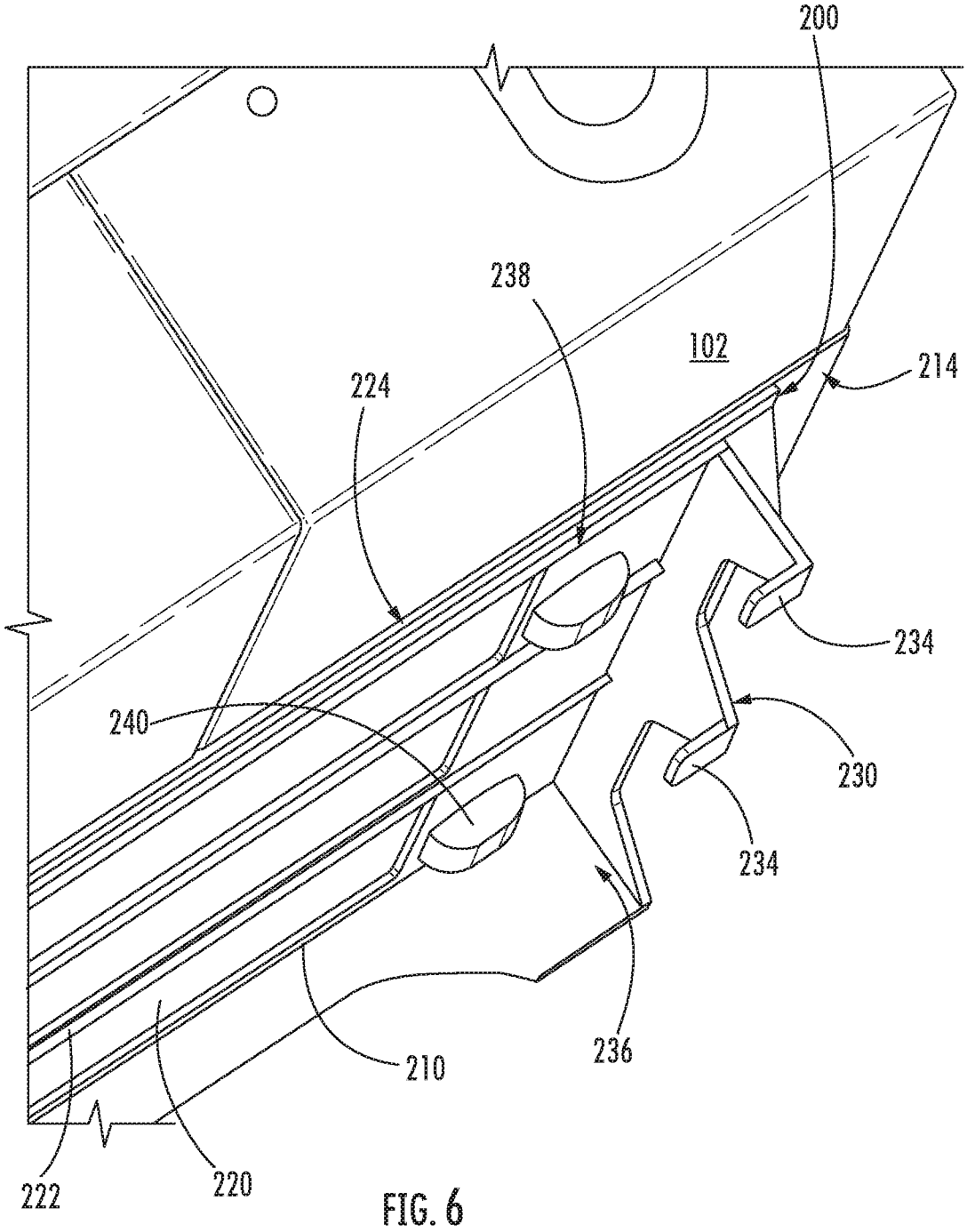
FIG. 6 provides another perspective view of the filter assembly mounted to the cabinet of the exemplary air conditioning appliance of FIG. 1.

As shown in FIGS. 5 and 6, filter assembly 200 may further include mounting brackets 230 that are configured for receiving a secondary air filter (e.g., identified herein by reference numeral 232). For example, the secondary air filter 232 may be any suitable filtering apparatus or product. For example, secondary air filter 232 may be a typical fibrous or porous air filter, such as a high-efficiency particulate air filter (HEPA filter). According to alternative embodiments, the secondary air filter 232 may be formed from foam, pleated paper, spun fiberglass, woven cotton, etc. In addition, such a secondary air filter 232 may have any suitable size or thickness, and mounting brackets 230 be configured for receiving one or more sizes of air filters 232. For example, an air filter 232 may be a 1-inch, 2-inch, 3-inch, 4-inch, or any other suitable size of air filter commonly purchased at a hardware store or home improvement center.

According to the illustrated embodiment, mounting brackets 230 include a plurality of L-shaped retention arms 234 that are designed to wrap around a forward end of secondary air filter 232. In this manner, secondary air filter 232 may slide into a receiving slot 236 defined by mounting brackets 230 from a top opening 238. Once installed, gravity and the force of indoor air 116 may secure secondary air filter 232 in receiving slot 236. As shown, secondary air filter 232 is positioned upstream of filter screen 220, though other orientations are possible and within the scope of the present subject matter.

According to exemplary embodiments, the filter frame 210 may further define clearance features 240 configured for receiving the heads of fasteners (e.g. as identified by reference numeral 242 in FIG. 4). In this regard, mechanical fasteners may be used to secure internal components of air conditioner 100 to cabinet 102 or inlet frame 214. As a result, fastener heads 242 may be exposed on an outside or upstream end of inlet frame 214. In order to achieve a flush mount of filter frame 210 against inlet frame 214, clearance features 240 provide voids within filter frame 210 in which the fasteners ends 242 may be positioned after installation of filter frame 210.

As explained above, cabinet 102 defines a plurality of mounting features 202 and filter frame 210 defines a plurality of attachment features 204 that are configured for engaging the mounting features 202 to secure filter frame 210 over indoor inlet 138. As noted above, mounting features 202 and attachment features 204 are generally designed to simplify installation of filter assembly 200, e.g., such that a one-handed installation process may be achieved and mechanical fasteners may be eliminated entirely. It should be appreciated that a variety of mounting features 202 and attachment features 204 may be used to provide such engagement between inlet frame 214 and filter frame 210. Although exemplary features are described herein, it should be appreciated that the present subject matter is not intended to be limited to such mounting features 202 and attachment features 204.

As best shown in FIGS. 4 through 8, according to one exemplary embodiment, mounting features 202 include slots 250 defined in inlet frame 214. By contrast, attachment features 204 include clips 252 that protrude from an aft and 224 of filter frame 210 for receipt within slots 250. Specifically, as illustrated, slots 250 and clips 252 may be positioned at four corners of the inlet frame 214 and filter frame 210, respectively. By contrast, any other suitable number and position of mounting features 202 and attachment features 204 may be used while remaining within scope of the present subject matter. As shown for example in FIG. 8, clips 252 may be S-shaped and may deflect a slightly when installed to ensure firm engagement between filter frame 210 in inlet frame 214. Alternatively, clips 252 may be simple hooks that are received within slots 250.

Figure 9:
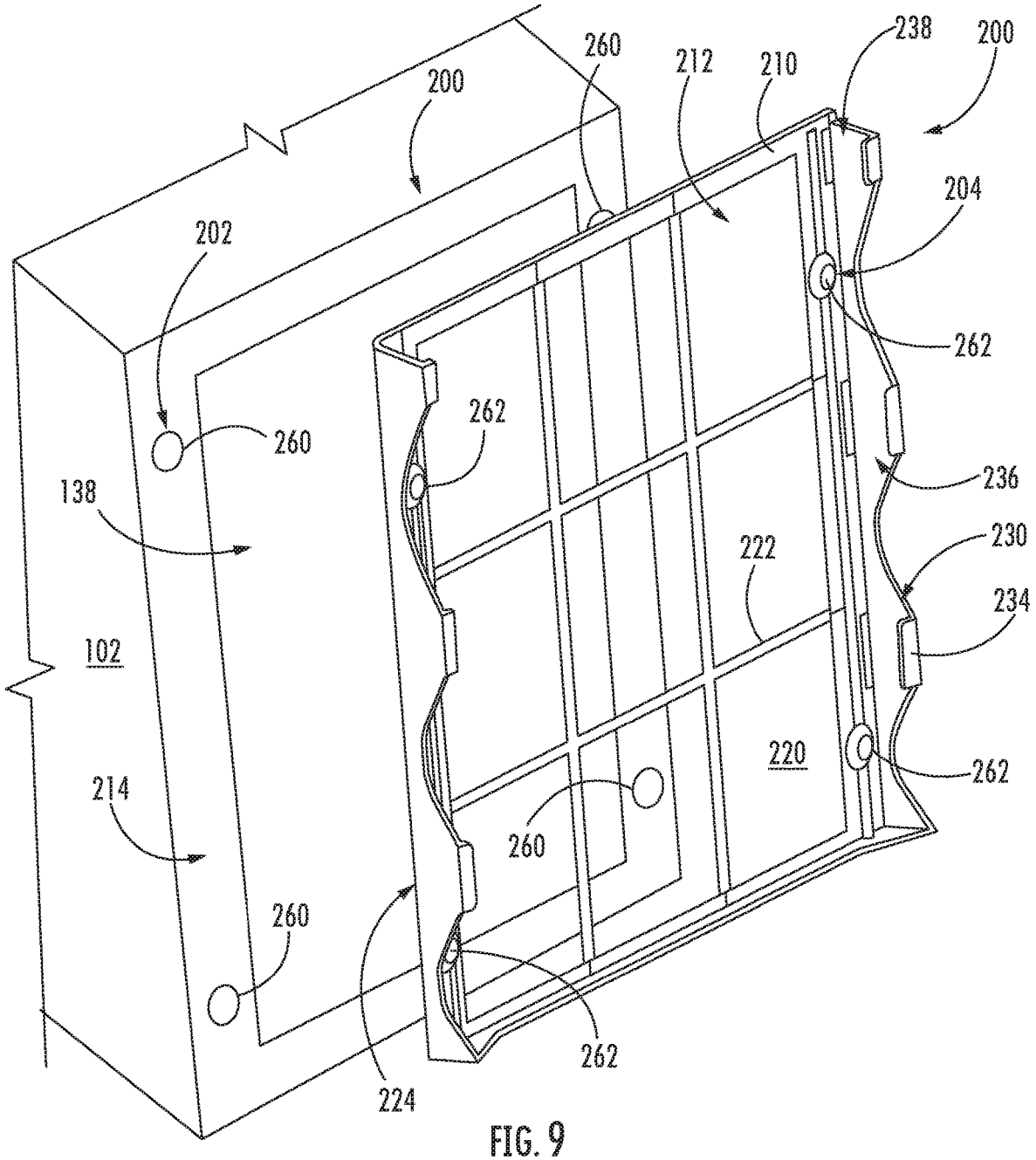
FIG. 9 provides a front perspective view of a filter assembly according to another exemplary embodiment of the present subject matter.
Figure 10:
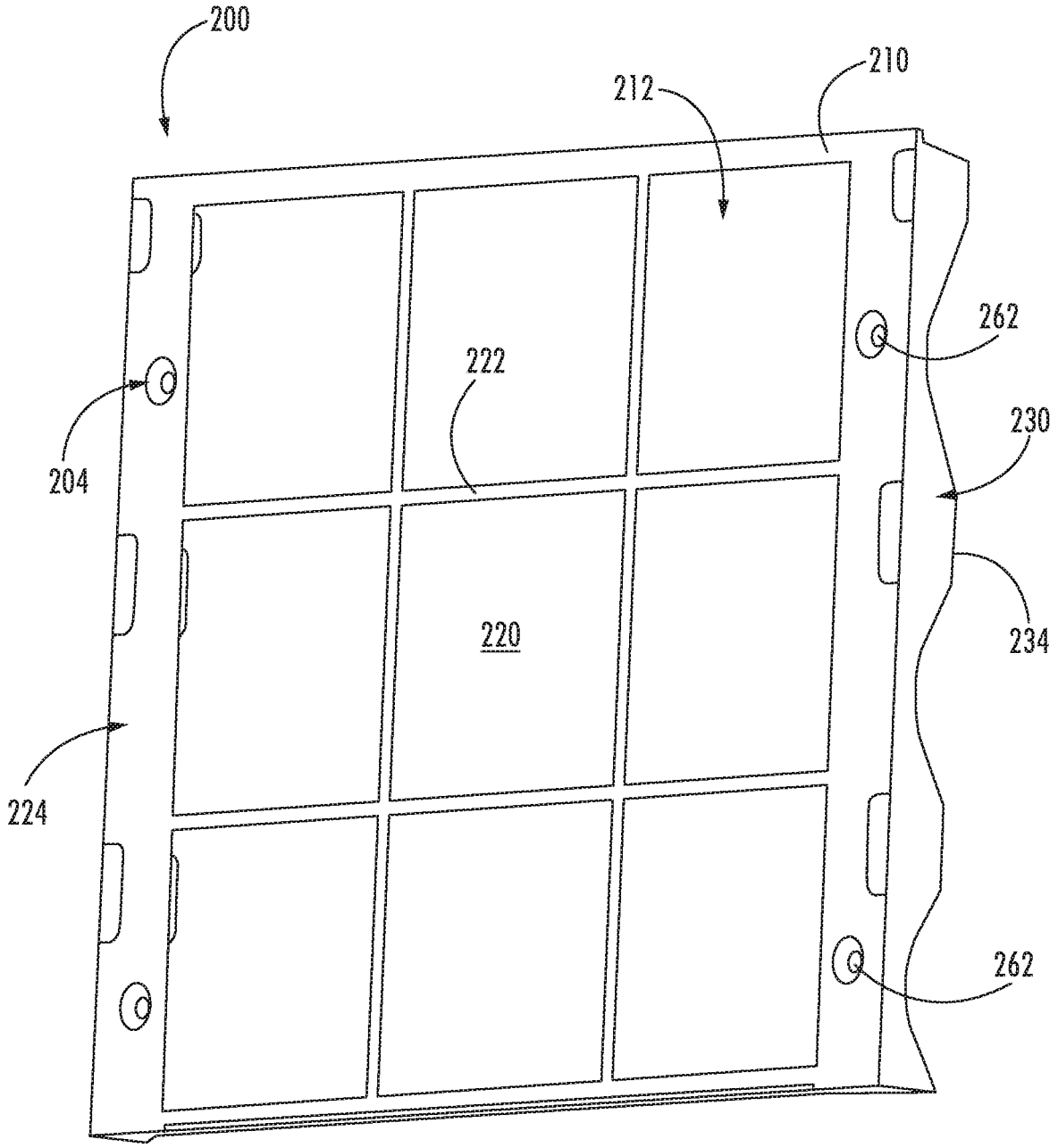
FIG. 10 provides a rear perspective view of the exemplary filter assembly of FIG. 9.

Referring now specifically to FIGS. 9 and 10, an alternative embodiment of filter assembly 200 will be described according to an exemplary embodiment. Like reference numerals may be used to refer to the same or similar features. As shown, filter assembly 200 may be similar to the filter assembly described above with the exception of mounting features 202 and attachment features 204. Specifically, as illustrated, mounting features 202 are frame magnets 260 that are mounted to inlet frame 214 in any suitable manner. Similarly, attachment features 204 are filter magnets 262 mounted to filter frame. In this regard, a magnetic force generated between frame magnets 260 and filter magnets 262 is used to secure filter frame 210 to inlet frame 214. In this regard, installation of filter assembly 200 may include simply positioning filter frame 210 over inlet frame 214 to secure filter frame 210. According still other embodiments, mounting features 202 and attachment features 204 may be interference pins and apertures. In this regard, filter frame 210 may define a plurality of pins having a diameter slightly larger than the plurality of apertures defined in inlet frame 214. In this regard, filter frame 210 may be pressed into place, and interference between the pins and apertures will retain filter frame during operation.

Although FIGS. 9 and 10 illustrated an exemplary embodiment that uses both frame magnets 260 and filter magnets 262 to attach filter frame 210 to inlet frame 214, it should be appreciated that other magnet arrangements could be used according to alternative embodiments. For example, if inlet frame 214 is made from a suitable metallic material, filter frame 210 could be secured using only filter magnets 262. According to another exemplary embodiment, if frame magnets 260 were mounted to inlet frame 214, filter frame 210 could be installed quickly and easily if a portion of filter frame 210 was constructed from metal or if a metal plate were attached to filter frame 210 at desired locations. Other magnetic attachment configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:

a cabinet defining an indoor inlet and a plurality of mounting features;

a bulkhead positioned within the cabinet and defining an indoor portion and an outdoor portion;

a filter assembly positioned adjacent the indoor inlet, the filter assembly comprising:

a filter frame defining a plurality of attachment features for engaging the plurality of mounting features to secure the filter frame over the indoor inlet, wherein the filter frame defines a mounting bracket for receiving a secondary air filter; and a filter screen attached to the filter frame for filtering a flow of air through the indoor inlet.

2. The air conditioner unit of claim 1, wherein the plurality of mounting features are slots defines in an inlet frame that defines the indoor inlet, and wherein the plurality of attachment features are clips that protrude from the filter frame for receipt within the slots.

3. The air conditioner unit of claim 1, wherein at least one of the plurality of attachment features or the plurality of mounting features comprises a magnet for securing the filter frame to the cabinet.

4. The air conditioner unit of claim 1, wherein the plurality of mounting features are frame magnets mounted to an inlet frame that defines the indoor inlet, and wherein the plurality of attachment features are filter magnets mounted to the filter frame, wherein a magnetic force generated between the frame magnets and the filter magnets secures the filter frame to the inlet frame.

5. The air conditioner unit of claim 1, wherein the plurality of mounting features are apertures defined in an inlet frame that defines the indoor inlet, and wherein the plurality of attachment features are pins for forming an interference fit within the apertures when the filter frame is installed.

6. The air conditioner unit of claim 1, wherein the plurality of mounting features includes four mounting features positioned proximate corners of an inlet frame, and wherein the plurality of attachment features includes four attachment features position proximate corners of the filter frame.

7. The air conditioner unit of claim 1, wherein the filter frame further comprises cross supports extending within a plane orthogonal to the transverse direction proximate an aft end of the filter frame.

8. The air conditioner unit of claim 1, wherein the filter frame is injection molded as a single, integral piece.

9. The air conditioner unit of claim 1, wherein the filter screen is overmolded onto the filter frame.

10. The air conditioner unit of claim 1, wherein the filter frame defines clearance features for receiving fasteners heads when the filter frame is installed on the cabinet.

11. A filter assembly for an air conditioner unit, the air conditioner unit comprising a cabinet defining an indoor inlet and a plurality of mounting features, the filter assembly comprising:

a filter frame defining a plurality of attachment features for engaging the plurality of mounting features to secure the filter frame over the indoor inlet, wherein the filter frame defines a mounting bracket for receiving a secondary air filter; and a filter screen attached to the filter frame for filtering a flow of air through the indoor inlet.

12. The filter assembly of claim 11, wherein the plurality of mounting features are slots defines in an inlet frame that defines the indoor inlet, and wherein the plurality of attachment features are clips that protrude from the filter frame for receipt within the slots.

13. The filter assembly of claim 11, wherein at least one of the plurality of attachment features or the plurality of mounting features comprises a magnet for securing the filter frame to the cabinet.

14. The filter assembly of claim 11, wherein the plurality of mounting features are frame magnets mounted to an inlet frame that defines the indoor inlet, and wherein the plurality of attachment features are filter magnets mounted to the filter frame, wherein a magnetic force generated between the frame magnets and the filter magnets secures the filter frame to the inlet frame.

15. The filter assembly of claim 11, wherein the plurality of mounting features are apertures defined in an inlet frame that defines the indoor inlet, and wherein the plurality of attachment features are pins for forming an interference fit within the apertures when the filter frame is installed.

16. The filter assembly of claim 11, wherein the plurality of mounting features includes four mounting features positioned proximate corners of an inlet frame, and wherein the plurality of attachment features includes four attachment features position proximate corners of the filter frame.

17. The filter assembly of claim 11, wherein the filter frame further comprises cross supports extending within a plane orthogonal to a transverse direction proximate an aft end of the filter frame.

18. The filter assembly of claim 11, wherein the filter frame is injection molded as a single, integral piece, and wherein the filter screen is overmolded onto the filter frame.

19. An air conditioner unit defining a vertical, a lateral, and a transverse direction, the air conditioner unit comprising:

a cabinet defining an indoor inlet and a plurality of mounting features;

a bulkhead positioned within the cabinet and defining an indoor portion and an outdoor portion;

a filter assembly positioned adjacent the indoor inlet, the filter assembly comprising:

a filter frame defining a plurality of attachment features for engaging the plurality of mounting features to secure the filter frame over the indoor inlet, wherein the filter frame defines clearance features for receiving fasteners heads when the filter frame is installed on the cabinet; and a filter screen attached to the filter frame for filtering a flow of air through the indoor inlet.

20. The air conditioner unit of claim 19, wherein the filter frame defines a mounting bracket for receiving a secondary air filter.

* * * * *